US010017956B1

(12) United States Patent
Chiang

(10) Patent No.: US 10,017,956 B1
(45) Date of Patent: Jul. 10, 2018

(54) MODULAR FENCE TENT

(71) Applicant: LI HSEN PLASTICS CO., LTD., New Taipei (TW)

(72) Inventor: San-Lang Chiang, New Taipei (TW)

(73) Assignee: LI HSEN PLASTICS CO., LTD., New Taipei (TW)

( * ) Notice: Subject to any disclaimer, the term of this patent is extended or adjusted under 35 U.S.C. 154(b) by 0 days.

(21) Appl. No.: 15/405,281

(22) Filed: Jan. 12, 2017

(51) Int. Cl.

| | |
|---|---|
| ***E04H 15/02*** | (2006.01) |
| ***A47D 13/02*** | (2006.01) |
| ***E04H 15/00*** | (2006.01) |
| ***E04H 15/18*** | (2006.01) |
| ***E04H 15/36*** | (2006.01) |
| ***E04H 15/44*** | (2006.01) |
| ***E04H 17/18*** | (2006.01) |
| ***E04H 17/16*** | (2006.01) |
| ***A47D 13/06*** | (2006.01) |
| ***E04H 15/56*** | (2006.01) |
| *E04H 17/14* | (2006.01) |

(52) U.S. Cl.
CPC ..... *E04H 15/006* (2013.01); *A47D 13/06* (2013.01); *E04H 15/02* (2013.01); *E04H 15/18* (2013.01); *E04H 15/36* (2013.01); *E04H 15/44* (2013.01); *E04H 15/56* (2013.01); *E04H 17/165* (2013.01); *E04H 17/18* (2013.01); *E04H 2017/1447* (2013.01)

(58) Field of Classification Search
CPC ..... E04H 15/02; E04H 15/36; E04H 15/44; E04H 15/18; E04H 15/34; E04H 1/02; E04H 15/56; E04H 15/006; E04H 17/165; E04H 17/18; E04H 2017/1447; A47D 13/06; A47D 7/00; A47D 15/00; A47D 11/007
USPC ..... 135/96, 124, 136, 137, 116, 115, 158, 135/160, 161; 5/93.1, 112–113, 99.1; 220/9.1–9.2; 256/25
See application file for complete search history.

(56) References Cited

U.S. PATENT DOCUMENTS 4,790,340 A * 12/1988 Mahoney ..... A47C 29/003 135/127
5,862,548 A * 1/1999 Gerhart ..... A47D 13/06 135/117
6,076,205 A * 6/2000 Yang ..... A47D 7/04 403/205
6,123,091 A * 9/2000 Flynn ..... A47C 29/003 135/116

(Continued)

*Primary Examiner* — Winnie Yip
(74) *Attorney, Agent, or Firm* — Leong C. Lei

(57) ABSTRACT

A modular fence tent includes plural connecting rods, plural supporting rods and a bottom cover, and both ends of each connecting rod have a connecting slot and a connecting block configured to be corresponsive to each other, and the plurality of connecting rods are connected sequentially to form an upper circular frame and a lower circular frame, and then the supporting rods are connected between the upper circular frame and the lower circular frame to form a fence-type frame, and finally the bottom cover covers the exterior of the fence-type frame to form the whole tent. The tent can be installed, removed, used, and stored conveniently. In addition, an elastic roof is combined to form the modular fence tent. The convenience and functionality of the tent are improved significantly and areas are well separated for kids' activities.

6 Claims, 5 Drawing Sheets

(56) References Cited

U.S. PATENT DOCUMENTS

| | | | | |
|---|---|---|---|---|
| 6,477,721 | B2 * | 11/2002 | Lee | E04H 4/0056 4/506 |
| 6,687,927 | B1 * | 2/2004 | Tharalson | A47D 13/06 220/495.01 |
| 6,702,119 | B2 * | 3/2004 | Sabounjian | A47B 43/04 190/107 |
| 6,866,009 | B2 * | 3/2005 | Smith, Jr. | A01K 1/0254 119/840 |
| 6,874,177 | B2 * | 4/2005 | Hsia | A47D 7/03 5/93.1 |
| 7,481,234 | B1 * | 1/2009 | Gustafson | E04H 15/425 135/156 |
| 8,137,242 | B2 * | 3/2012 | VanElverdinghe | A63B 5/11 482/27 |
| 9,512,631 | B2 * | 12/2016 | Andon | A63B 5/11 |
| 2010/0294759 | A1 * | 11/2010 | Yu | E04H 15/006 220/9.3 |

* cited by examiner

MODULAR FENCE TENT

FIELD OF INVENTION

The present invention relates to the field of a kid's play equipment, in particular to a modular transformable tent house that can be installed or uninstalled quickly to facilitate its use and storage.

BACKGROUND OF INVENTION

1. Description of the Related Art

The growing process of kids includes different stages from crawling to walking. In general, the kids' moving speed and height are increased, and kids are very curious to their surroundings. However, the balance system of the kids is still not fully developed, so that the kids may fall or get injured easily while playing. In addition, such period is a period for a rapid growth of the body sensory integration of the kids, and such period is very important to infants and kids. Therefore, it is an important subject for related designers and manufacturers to provide a safe playing environment, allow the kids to grow while playing, and prevent dangers or accidents caused by falling or leaving the sight within a playing area.

At present, various playing equipments such as playing tents or ball pools are available in the market, and these equipments generally pop up a fabric frame structure having a bottom and a sealed periphery by using highly elastic fine wire and fabric, and a cloth cushion is set to the bottom to form a closed area to serve as a playing area, so that parents can put their kids in the playing equipment (tent or ball pool) safely. In the meantime, toys or balls may be put into the playing equipment and provided for the kids to play therein. By using the highly elastic fine wire as a support, the playing equipment can be folded into a smaller structure for a convenient storage, when the playing equipment is not in use. However, each fabric piece of the playing equipment with the aforementioned design is connected by sewing. In addition, the support force provided by the highly elastic fine wire is insufficient to resist the pushing force of the kids, particularly for these convenient foldable game equipments, since most of these equipments have the highly elastic fine wires installed on the contour of the structure only. As a result, the equipment is usually pulled down and often causes accidents or injuries to the kids. Alternatively, there is a design using an inflatable airbag structure as a support body to provide a better supporting effect and cushioning elasticity, but it takes much time and effort to inflate and deflate the airbag structure for using and storing the airbag structure, and these inflatable airbags are made of plastic fabric and assembled by heat sealing and bonding. When the airbags are pierced by a sharp object or pressed by a large force, a leakage or crack of the airbags may occur.

Therefore, the inventor of the present invention designed a modular fence tent with a firm fence-shaped structure and a playing space formed at a bottom cover, and the modular fence tent is durable and the storage operation and volume will not be affected, so as to improve the convenience and functionality of the tent significantly.

SUMMARY OF THE INVENTION

In view of the aforementioned drawbacks of the prior art, it is a primary objective of the present invention to provide a modular fence tent comprising a plurality of connecting rods sequentially installed to form upper and lower circular frames, and a plurality of supporting rods for separation and support, and the upper and lower circular frames form a three-dimensional circular fence frame, and a bottom cover for covering and forming a modular fence. The present invention provides convenient assembling, removal, use, and storage. In addition, the present invention further combines an elastic roof to the top of the bottom cover to form a modular fence tent. The invention improves the convenience of use and functionality of the tent significantly, and areas are well separated for kids' activities.

To achieve the aforementioned and other objectives, the present invention provides a modular fence tent, comprising: a plurality of connecting rods, each having a connecting slot and a connecting block disposed at both ends of the connecting rod respectively and configured to be corresponsive to each other, and the connecting rods being coupled sequentially to form an upper circular frame and a lower circular frame; a plurality of supporting rods, each having a socket portion disposed at both ends of the supporting rod and configured to be corresponsive to the upper circular frame and the lower circular frame, and the socket portions being coupled between the upper circular frame and the lower circular frame to form a fence-type frame; and a bottom cover, being a circular fence structure formed by a base fabric and a circular fence, and the base fabric being made in the shape corresponsive to the lower circular frame and provided for covering the exterior of the fence-type frame to form a whole modular fence tent.

In a preferred embodiment, each connecting rod has a cross-section in a circular shape, and the cross-sectional shape of the socket portion is greater than a circular arc structure of the radius of the connecting rod. After the connecting rod is sheathed into the socket portion to define a compressed and fixed status, so as to achieve the effect of improving the strength.

To increase the stability after the circular fence frame and the bottom cover are assembled, a plurality of fixing portions disposed on an inner surface of the bottom cover and configured to be corresponsive to the supporting rods respectively are wounded to cover each supporting rod, so that the bottom cover and the fence-type frame are combined integrally. In addition, the fixing portion is one selected from the group consisting of a Velcro tape, a magnetic member, and a buckle nail. To facilitate the installation, removal and storage of the tent, the supporting rods of the present invention have a modular design, and the supporting rod is formed by a rod at the center of the supporting rod and the two socket portions sheathed on both ends of the supporting rod respectively, so that the tent can be assembled and installed conveniently for use or removed and stored easily when not in use.

To further improve the functionality of the tent and the convenience of installing the tent, the present invention further comprises a plurality of accommodation bags disposed on a surface of the bottom cover, and the accommodation bag has a pocket facing upward. An elastic roof is combined to form a game equipment with a tent function, and both sides of the elastic roof are disposed respectively and symmetrically in the two accommodation bags, so that the center portion is protruded after being bent. In addition, the elastic roof is formed by wrapping an elastic support arm around a fabric surface, and the elastic support arm is selected from the group consisting of a PE tube and a high manganese wire, so as to facilitate bending and storing the tent.

In a preferred embodiment, the upper circular frame and the lower circular frame are formed by at least three connecting rods to reduce the storage volume of the tent and avoid having too-long connecting rods.

DESCRIPTION OF THE PREFERRED EMBODIMENTS

The above and other objects, features and advantages of this disclosure will become apparent from the following detailed description taken with the accompanying drawings.

Figure 1:
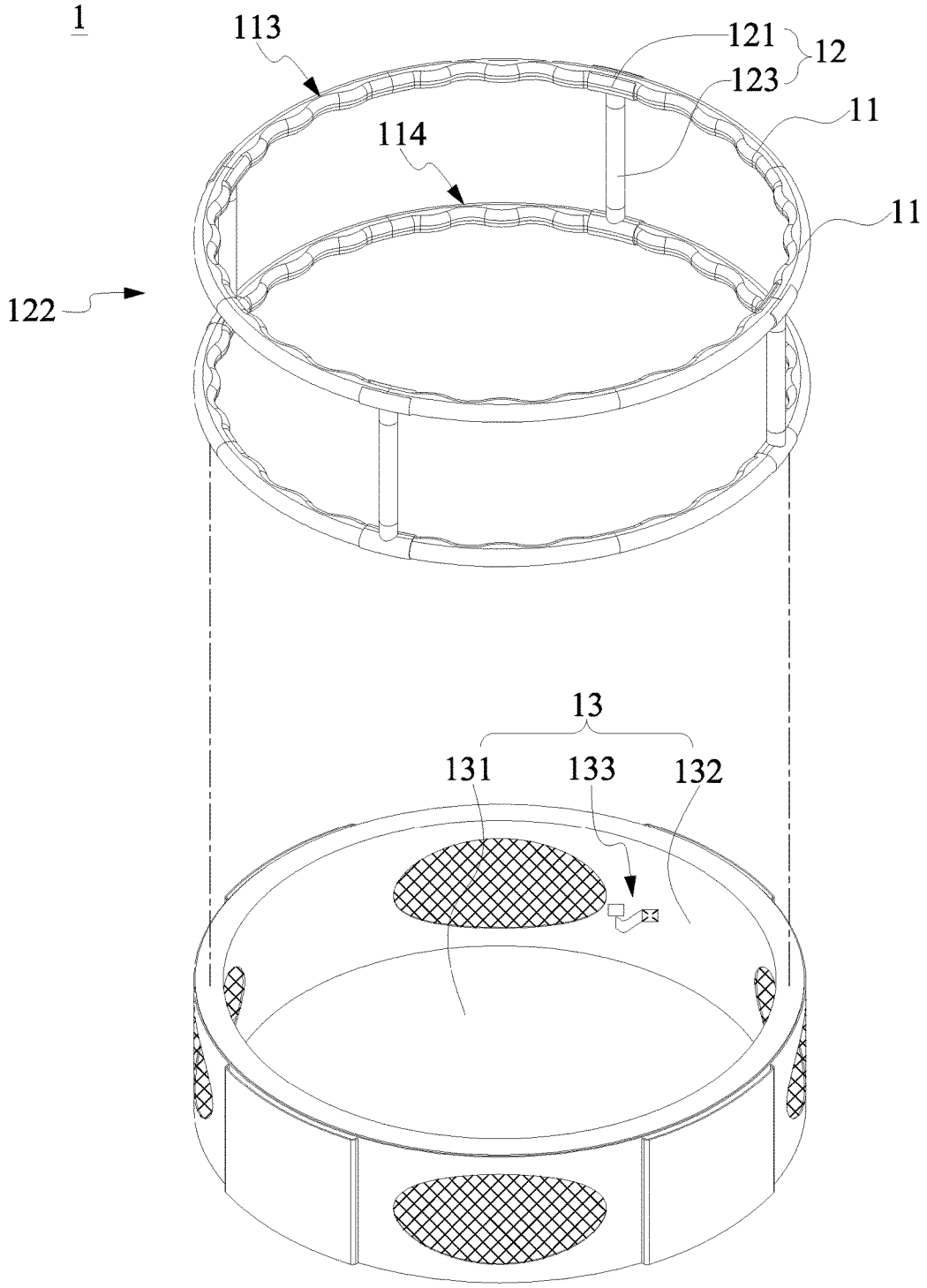
FIG. 1 is a schematic view showing a structure of a preferred embodiment of the present invention.
Figure 2:
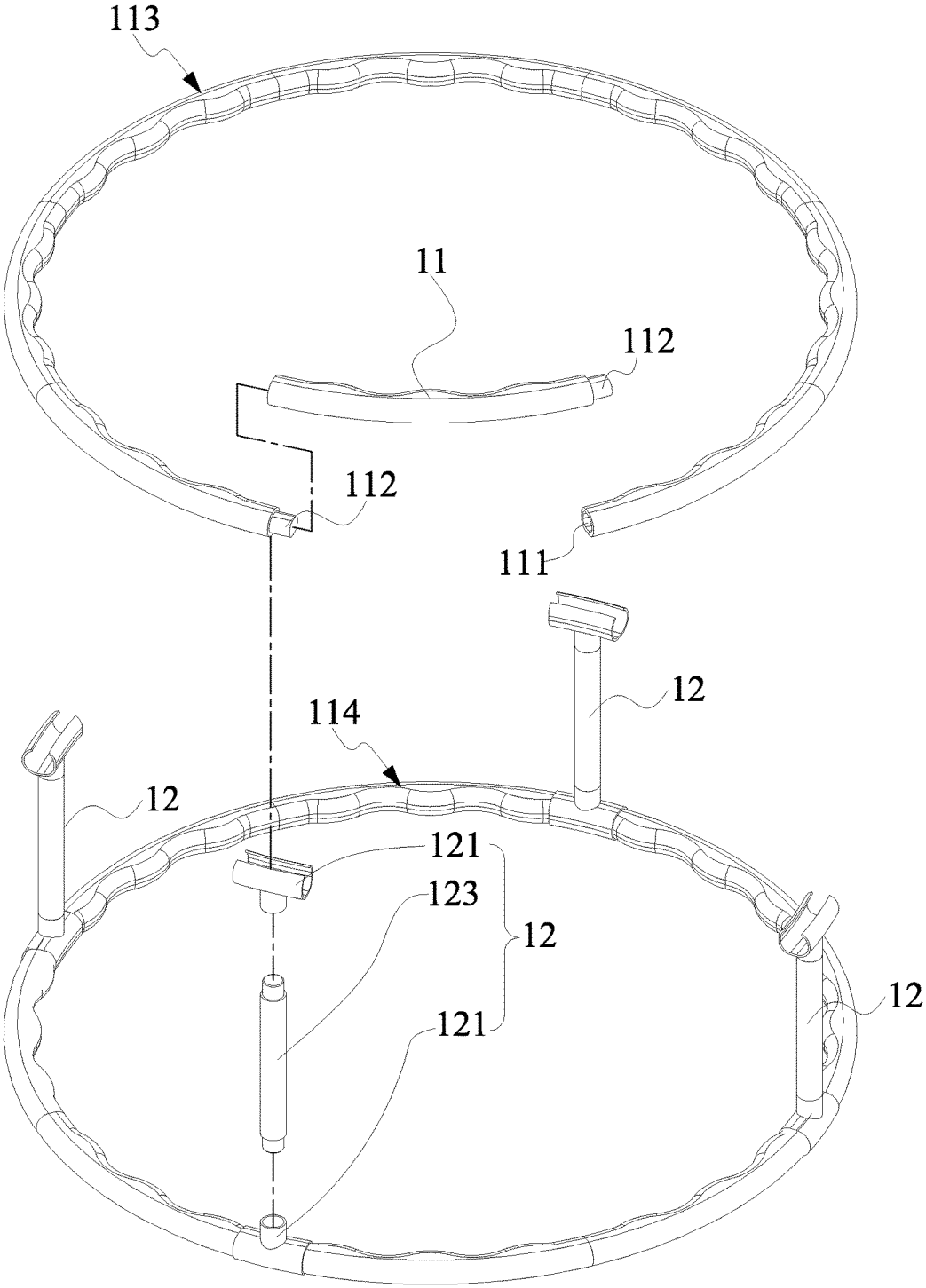
FIG. 2 is a schematic view of installing a circular fence type frame of a preferred embodiment of the present invention.
Figure 3:
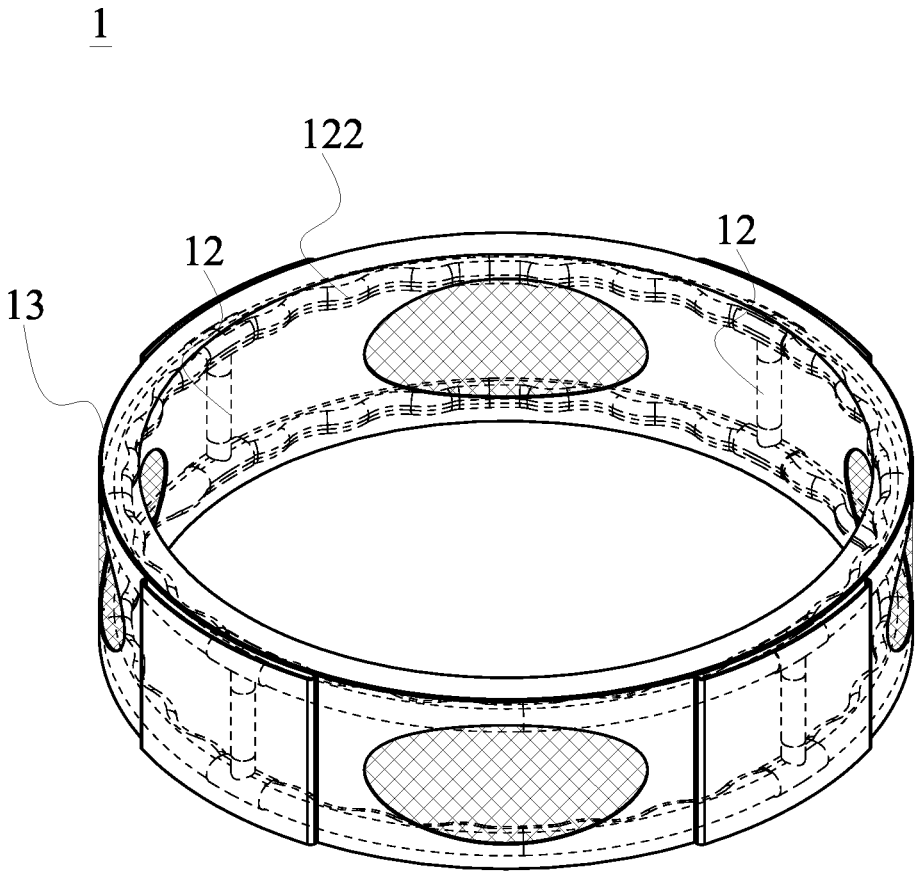
FIG. 3 is a perspective view of a preferred embodiment of the present invention.

With reference to FIGS. 1 to 3 for a schematic view of a structure, a schematic view of installing a circular fence frame, and a perspective view of a preferred embodiment of the present invention respectively, the present invention provides a modular fence tent 1 comprising a plurality of connecting rods 11, a plurality of supporting rods 12 and a bottom cover 13.

Wherein, both ends of each connecting rod 11 have a connecting slot 111 and a connecting block 112 configured to be corresponsive to each other, and the connecting block 112 of two adjacent connecting rods 11 is inserted into the connecting slot 111 to complete fixing the connecting block 112 and the connecting slot 111, and the remaining connecting rods 11 are sequentially connected in series to form an upper circular frame 113 and a lower circular frame 114. It is noteworthy that after actual testing, the inventor of the present invention believes that the upper circular frame 113 and the lower circular frame 114 are preferably made of at least three connecting rods 111 in order to improve the convenience of installation and the volume for storage, so as to reduce the number of the connecting rods 11, simplify the complicated assembling procedure, and improve the strength of the tent.

Both ends of each supporting rod 12 have a socket portion 121 configured to be corresponsive to the upper circular frame 113 and the lower circular frame 114 and provided for connecting between the upper circular frame 113 and the lower circular frame 114 to form a fence-type frame 122, wherein each connecting rod 11 has a cross-section in a circular shape, and the sectional shape of the socket portion 12 is greater than a circular arc structure of the radius of the connecting rod 11, so that the assembled connecting rod 11 and socket portion 12 will not fall apart from each other easily after they are latched. However, the shape of the socket portion 121 may be changed as needed. For example, the connecting rod 11 is passed to define a fixed form.

The bottom cover 13 is a circular fence structure formed by a base fabric 131 and a circular fence 132, and the base fabric 131 is manufactured in the shape of the lower circular frame 114 and provided for covering the exterior of the fence-type frame 122 to form the whole tent. In addition, a section of fabric material is inwardly extended from the top edge of the circular fence 132 and provided for covering the top of the upper circular frame 113 of the fence-type frame 122 to improve the supporting effect of the fence-type frame 122.

In addition, a plurality of fixing portions 133 are disposed on an inner surface of the bottom cover 13 and configured to be corresponsive to the supporting rods respectively, and provided for covering and fixing each supporting rod 12 by winding, so that the bottom cover 13 and the fence-type frame 122 are combined integrally, and the fixing portion 133 is one selected from the group consisting of a Velcro tape, a magnetic member, and a buckle nail. In addition, the supporting rod 12 has a modular design, and the supporting rod 12 is formed by a rod 123 at the center of the supporting rod 12, and the two socket portions 121 sheathed on both ends of the supporting rod 12.

Figure 4:
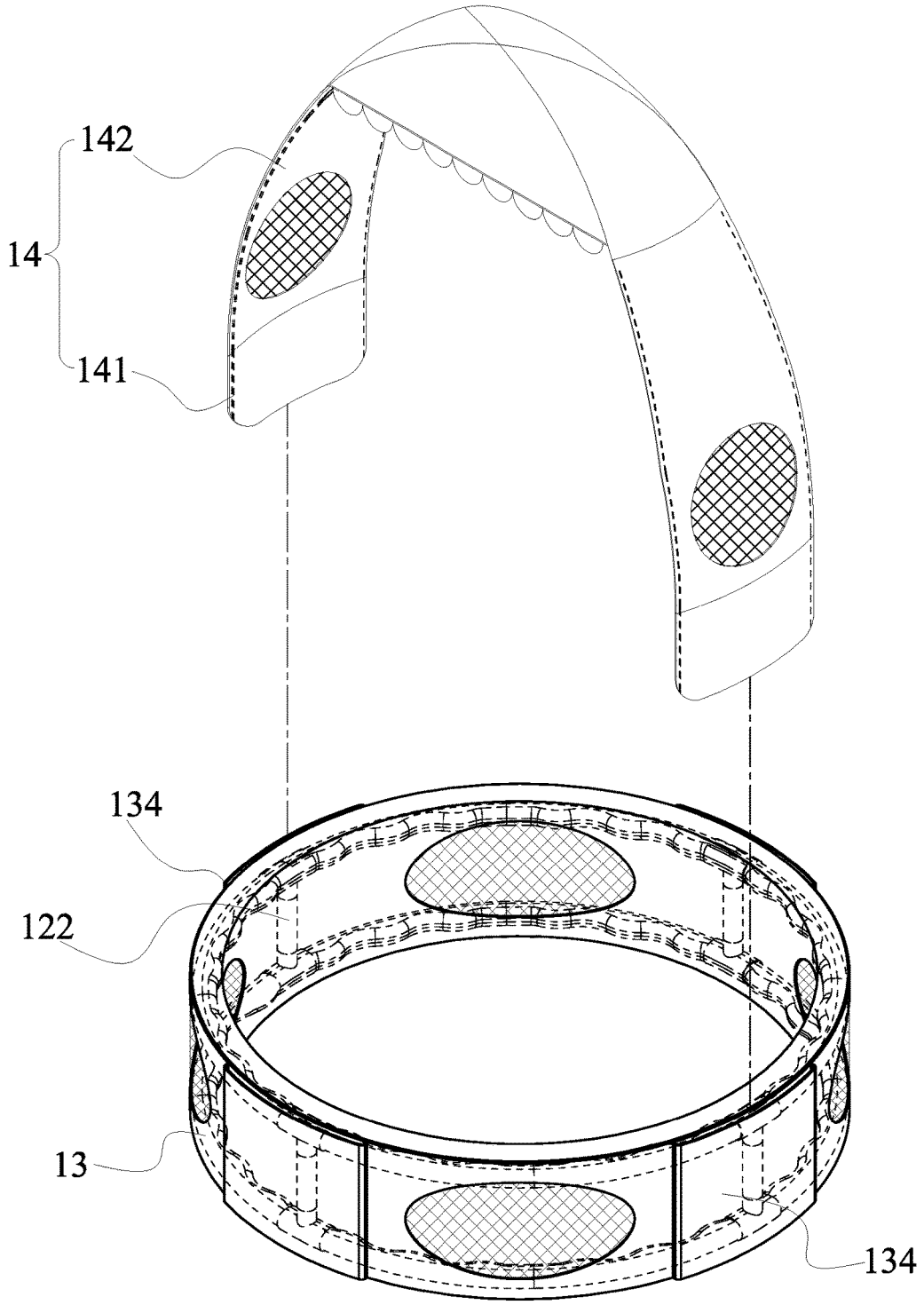
FIG. 4 is a schematic view of installing a preferred embodiment of the present invention.
Figure 5:
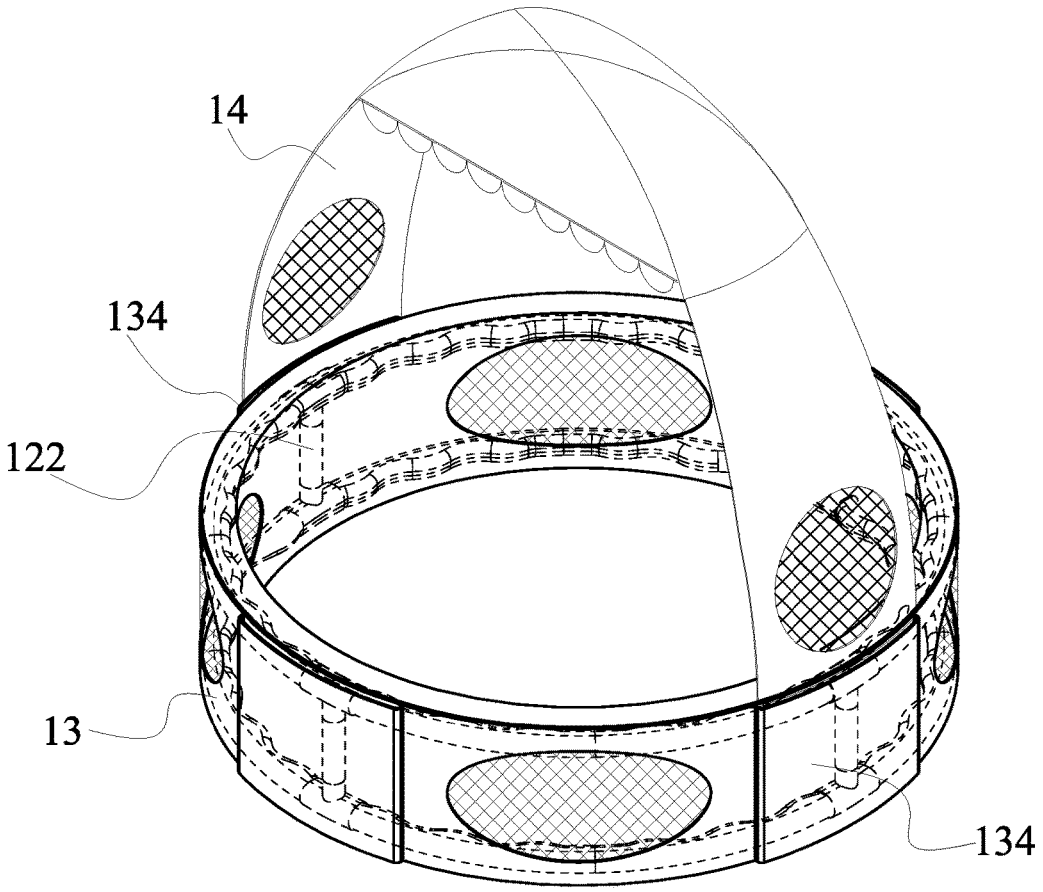
FIG. 5 is a perspective view of another preferred embodiment of the present invention.

With reference to FIGS. 4 and 5 for a schematic view of installing another preferred embodiment of the present invention and perspective view of the assembly of the other preferred embodiment of the present invention, the connecting rod 11, the supporting rods 12 and the bottom cover 13 are assembled in the same way as the previous preferred embodiment, except that the inner surface or the external surface of the bottom cover 13 has a plurality of accommodation bags 134 disposed thereon, and the accommodation bags 134 are paired and symmetrically disposed two opposite sides of the bottom cover 13, and the accommodation bag 134 has a pocket facing upward for installing an elastic roof 14, and the elastic roof 14 is a long-strip structure formed by winding an elastic support arm 141 around a fabric surface 142, wherein the elastic support arm 141 is selected from the group consisting of a PE tube and a high manganese wire, and thus the elastic roof 14 has a good resilience, and the elastic roof 14 can be bent into an arch shape, or the elastic roof 14 may be in an inverted V-shape, and both outermost edges of the elastic roof 14 are disposed respectively and symmetrically in the two accommodation bags 134, so that the central portion of the elastic roof 14 is protruded after being bent, and a game equipment with a fence function is formed to improve the privacy while the kids are playing.

What is claimed is:

1. A modular fence tent, comprising:

a plurality of connecting rods, each having a connecting slot and a connecting block disposed at both ends of the plurality of connecting rods respectively and configured to be corresponsive to each other, and the plurality of connecting rods being coupled sequentially to form an upper circular frame and a lower circular frame;

a plurality of supporting rods, each having a socket portion disposed at both ends of the plurality of supporting rods and configured to be corresponsive to the upper circular frame and the lower circular frame, and the socket portion being coupled between the upper circular frame and the lower circular frame to form a frame; and a bottom cover, being a circular fence structure formed by a base fabric and a circular fence, and the base fabric being made in a shape corresponsive to the lower circular frame and provided for covering the exterior of the fence-type frame to form a whole modular fence tent, wherein the bottom cover has a plurality of accommodation bags disposed on a surface of the bottom cover, and the plurality of accommodation bags has a pocket facing upward, wherein the modular fence tent further comprises an elastic roof, and both sides of the elastic roof being symmetrically are disposed in the two accommodation bags respectively, so that a central portion of the elastic roof is protruded after being bent.

2. The modular fence tent of claim 1, wherein the elastic roof is formed by winding an elastic support arm to a fabric surface, and the elastic support arm is selected from a group consisting of a PE tube and a high manganese wire.

3. The modular fence tent of claim 2, wherein the upper circular frame and the lower circular frame are formed by at least three connecting rods.

4. A modular fence tent, comprising:

a plurality of connecting rods, each having a connecting slot and a connecting block disposed at both ends of the plurality of connecting rods respectively and configured to be corresponsive to each other, and the plurality of connecting rods being coupled sequentially to form an upper circular frame and a lower circular frame;

a plurality of supporting rods, each having a socket portion disposed at both ends of the plurality of supporting rods and configured to be corresponsive to the upper circular frame and the lower circular frame, and the socket portion being coupled between the upper circular frame and the lower circular frame to form a frame; and a bottom cover, being a circular fence structure formed by a base fabric and a circular fence, and the base fabric being made in a shape corresponsive to the lower circular frame and provided for covering the exterior of the frame to form a whole modular fence tent, wherein each of the plurality of connecting rods has a cross-section in a circular shape, and a radius of a cross-sectional shape of the socket portion is greater than a radius of a circular arc structure of the plurality of connecting rods, wherein the bottom cover has a plurality of fixing portions formed on an inner surface of the bottom cover and configured to correspond to the plurality of supporting rods respectively for surrounding and fixing to the surface of each of the plurality of supporting rods, so that the bottom cover and the fence-type frame are combined integrally, wherein the plurality of fixing portions is one selected from a group consisting of a Velcro tape, a magnetic member, and a buckle nail, wherein the plurality of supporting rods has a modular design, and each of the plurality of supporting rods is formed by a rod body at a center of each of the plurality of supporting rods and the two socket portions sheathed on both ends of the plurality of supporting rods, wherein the bottom cover has a plurality of accommodation bags disposed on a surface of the bottom cover, and the plurality of accommodation bags has a pocket facing upward, wherein the modular fence tent further comprises an elastic roof, and both sides of the elastic roof are symmetrically disposed in the two accommodation bags respectively, so that a central portion of the elastic roof is protruded after being bent.

5. The modular fence tent of claim 4, wherein the elastic roof is formed by winding an elastic support arm to a fabric surface, and the elastic support arm is selected from a group consisting of a PE tube and a high manganese wire.

6. The modular fence tent of claim 5, wherein the upper circular frame and the lower circular frame are formed by at least three connecting rods.

* * * * *